US005528992A

United States Patent [19]

Cole

[11] Patent Number: 5,528,992

[45] Date of Patent: Jun. 25, 1996

[54] RECIPROCATING COMBUSTION GRATE GUIDE SYSTEM

[75] Inventor: Arthur W. Cole, Rowley, Mass.

[73] Assignee: Wheelabrator Environmental Systems, Inc., Hampton, N.H.

[21] Appl. No.: 356,082

[22] Filed: Dec. 14, 1994

Related U.S. Application Data

[63] Continuation-in-part of Ser. No. 90,007, Jul. 12, 1993, Pat. No. 5,394,806, which is a continuation-in-part of Ser. No. 71,994, Jun. 7, 1993, Pat. No. 5,377,663.

[51] Int. Cl.[6] ..... F23K 5/00

[52] U.S. Cl. ..... 104/134; 110/289; 384/42

[58] Field of Search ..... 104/134, 162, 104/242; 384/42; 110/289, 290, 291, 109; 414/172

[56] References Cited

U.S. PATENT DOCUMENTS

| | | | |
|---|---|---|---|
| 1,053,020 | 2/1913 | Fetherston . | |
| 2,423,110 | 7/1947 | Mosshart . | |
| 2,452,804 | 11/1948 | Sulprizio . | |
| 2,675,276 | 4/1954 | Daugherty . | |
| 2,719,761 | 10/1955 | Bonnafe . | |
| 3,178,240 | 4/1965 | Davidson | 384/42 |
| 3,279,628 | 10/1966 | Brouwer et al. . | |
| 3,350,143 | 10/1967 | Lichowsky . | |
| 3,651,770 | 3/1972 | Hotti . | |
| 3,863,779 | 2/1975 | Stockman . | |
| 3,871,287 | 3/1975 | Spillman et al. . | |
| 3,934,521 | 1/1976 | Andreoli . | |
| 4,018,168 | 4/1977 | Andreoli et al. . | |
| 4,184,719 | 1/1980 | Ward . | |
| 4,440,095 | 4/1984 | Mathieu . | |
| 4,463,688 | 8/1984 | Andreoli . | |
| 4,571,137 | 2/1986 | Malmgren . | |
| 4,582,193 | 4/1986 | Larsson . | |
| 4,714,031 | 12/1987 | Healy et al. . | |
| 4,738,299 | 4/1988 | Hunter | 384/42 |
| 4,773,769 | 9/1988 | Church | 384/42 |
| 4,925,320 | 5/1990 | Foster et al. | 384/42 |
| 4,940,339 | 7/1990 | Amano | 384/42 |
| 4,944,383 | 7/1990 | Petrachkoff . | |
| 4,978,233 | 12/1990 | Stotzel et al. . | |
| 5,004,097 | 4/1991 | Roinestad et al. . | |
| 5,394,806 | 3/1995 | Cole et al. | 104/134 |

FOREIGN PATENT DOCUMENTS

| | | |
|---|---|---|
| 1111989 | 3/1956 | France . |
| 698692 | 11/1940 | Germany . |
| 2-150507 | 6/1990 | Japan . |
| 348601 | 5/1931 | United Kingdom . |

*Primary Examiner*—Mark T. Le
*Attorney, Agent, or Firm*—Banner & Allegretti, Ltd.

[57] ABSTRACT

A guide system for a reciprocating grate system having a grate surface, alternating rows of stationary and movable grate blocks, a movable carriage, a fixed undergrate structure, and a driving force device. The guide system includes guide units which guide the movable carriage and the movable rows of grate blocks with respect to the fixed undergrate structure and the stationary rows of grate blocks during reciprocating stroke cycles of the driving force device. Each guide unit includes a fixed guide member and a movable guide member. The fixed guide member is attached to the fixed undergrate structure and has an upper non-linear contour with wear plates, each having a wear surface. Each movable guide member is attached to the movable carriage and has a lower non-linear contour with wear plates, each having a wear surface. When the movable carriage is in an installed position, the wear surfaces are in slidable contact with each other. The wear plates on each guide member are angularly displaced from each other to maintain lateral alignment of the movable carriage and the movable grate block rows, and provide additional wear surface area to increase the useful life of the wear plates. The wear plates eliminate the need for lateral restraints, by maintaining lateral alignment of the movable carriage and the movable grate block rows. A levelling device, including levelling bolts on the fixed guide member, prevents uneven wear of the wear surfaces during operation.

16 Claims, 5 Drawing Sheets

RECIPROCATING COMBUSTION GRATE GUIDE SYSTEM

CROSS-REFERENCES TO RELATED APPLICATIONS

This application is a continuation-in-part of application Ser. No. 08/090,007, filed Jul. 12, 1993, now U.S. Pat. No. 5,394,806 and a continuation-in-part of application Ser. No. 08/071,994, filed Jun. 7, 1993, now U.S. Pat. No. 5,377,663 both of which are hereby incorporated by reference.

FIELD OF THE INVENTION

The present invention relates to incinerators, and more particularly to the grate combustion system of an incinerator. More specifically, the present invention relates to a guiding system for guiding movable rows of grate blocks with respect to stationary rows of grate blocks in facilities such as those which use refuse as a fuel source and typically generate steam for electrical power generation.

BACKGROUND OF THE INVENTION

The need to provide environmentally correct and cost effective solutions for the refuse generated in the Unites States became apparent in the late 1960's. At that time, refuse disposal was mainly by land filling and to a lesser extent incineration. That situation changed as landfill space became recognized as a finite resource and that refuse could be used as a fuel source which could displace other, more costly, fuel sources in the generation of process steam and electricity. Refuse-to-energy plants became a common source of energy.

A common refuse-to-energy facility, generally indicated by reference numeral 2, is shown in FIGS. 1–2. In operation, a crane or a front end loader, not shown, picks up a quantity of refuse from a refuse storage area and deposits it into charging hopper 4. Charging hopper 4 has a large plan area to facilitate this operation and acts as a funnel to feed the refuse to feed chute 6. Refuse travels down feed chute 6 by gravity until it reaches ram table 8 at the bottom of feed chute 6. Ram feeder 10 pushes refuse from ram table 8 horizontally onto furnace grate system 12 for incineration in combustion zone 14 of furnace 16. As refuse is being burned on grate system 12, flames and intense heat are given off. The heat given off from the burning of refuse in combustion zone 14 is recovered by water carrying boiler tubes 20 which line the walls 18 of furnace 16. Boiler tubes 20 are connected to adjacent boiler tubes by tube joining members 22.

A prior art reciprocating grate system 12 is illustrated in detail in FIG. 3. Grate system 12 is a forward moving reciprocating-type with rows of grate blocks inclined at an angle from the horizontal, e.g., 18°, as shown in FIGS. 1 and 2. The grate blocks are grouped into rows perpendicular to the direction of refuse flow. The rows of the grate blocks consist of alternating rows of stationary grate blocks 24 and reciprocating grate blocks 26. Each row of grate blocks overlaps the row ahead of it to provide the grate system surface.

Stationary grate block rows 24 are attached to supports 28. The bottom of supports 28 are affixed to a table 30 which forms a part of the fixed undergrate structure 32. Movable grate block rows 26 are supported by and attached to a common linearly movable carriage 34, via supports 33. Attachment of grate blocks 24 and 26 to supports 28 and 33 is made at the back part of the grate blocks which is located below the prior overlapping block.

Forward and rearward guide units **36*a* and 36*b* guide carriage 34 for reciprocatory motion with respect to fixed undergrate structure 32. Each guide unit 36 includes a ramp 38 fixedly mounted to fixed undergrate structure 32, and a wheel 40 mounted to carriage 34. Each wheel 40 is attached to carriage 34 via carriage mounting plate 42 for rotation about an axis perpendicular to the direction of refuse flow. Each wheel 40 includes an axle and a greased bearing arrangement, and is supported by a respective ramp 38 to permit the reciprocating motion of carriage 34 and reciprocating grate blocks 26. Further, supports 33 extend through, and travel within, longitudinal slots located in table 30 during the reciprocating motion of reciprocating grate blocks 26**.

A cylinder actuator 44 is attached at one end 46 to fixed undergrate substructure 32 and to movable carriage 34 at the other end 48. Cylinder actuator 44 provides the necessary force to reciprocate carriage 34 and movable rows of grate blocks 26 with respect to fixed undergrate substructure 32 and stationary rows of grate blocks 24. In operation, refuse is pushed onto the grate surface and the movable rows of grate blocks 26 push refuse along the grate surface at a speed dictated by cylinder actuator 44. Air is forced through air holes in fixed table 30 and through holes in the front edge of grate blocks 24 and 26, to control the combustion of the refuse on the grate.

However, there are many potential areas of failure which exist in this "wheel and ramp guide arrangement". First, trash siftings can fall down between the grate block rows and through the air holes and slots in table 30. These trash siftings can fall on one or more ramps 38 and act as a chock to interfere with the ability of wheels 40 to properly roll therealong. Even the binding of one wheel 40 has been known to cause misalignment of the grate blocks and damage the entire grating system 12.

Further, the wheel and ramp guide arrangement includes wheel bearings and axles. The bearings and axles can be expensive as they must be capable to withstand high temperatures for a prolonged period of time and also withstand high temperature differentials when the unit is being brought on and off-line. Additionally, the wheel bearings require periodic greasing. Greasing the wheel bearings is time consuming and requires the plant to be brought off-line because wheels 40 cannot be accessed while the plant is operating. Further, the grease itself can be expensive as it must be specially formulated to withstand the high temperatures and high temperature differentials around the grate.

The wheel and ramp guide arrangement may also be deficient as wheels 40 do not laterally restrain the movement of the carriage 34. Therefore, the grate system requires special lateral side plate restraints to inhibit significant lateral misalignment. However, these plate restraints wear out over time and need to be periodically replaced. As they are not easily accessible, they are expensive to replace. Further, if a side plate restraint is excessively worn and ceases to effectively restrain lateral movement of the carriage, misalignment of the grate blocks and damage the entire grating system 12 will likely occur.

Additionally, the wheel and ramp guide arrangement may also be deficient because it does not include levelling devices. Tolerances and warping of carriage 34 and fixed undergrate structure 32 make it highly unlikely that all the ramp surfaces will be level with respect to each other and level with respect to their respective wheel. This increases the likelihood that some wheels and ramps will wear faster and less evenly than the others, causing uneven wear of the wheels and ramps. When the wheel and ramp surfaces wear unevenly, the possibility of carriage misalignment significantly increases.

In another prior art guide arrangement for reciprocating grate systems, the movable carriage and the fixed undergrate structure are each provided with a flat slide surface. The flat slide surfaces interface to permit the reciprocating motion of the carriage and reciprocating grate blocks with respect to the fixed grate substructure and the stationary grate blocks. U.S. Pat. Nos. 3,651,770 and 3,871,287 illustrate different embodiments of such a "slide surface guide arrangement". However, this flat slide surface guide arrangement also has many deficiencies.

First, the flat slide surfaces do not laterally restrain the movement of the carriage. The system thus requires special lateral side plate restraints to inhibit significant lateral misalignment. As previously described, these plate restraints wear out over time, need to be periodically replaced at a high cost. Further, worn plate restraints can potentially cause grate block misalignment.

Additionally, this fiat slide surface guide arrangement is also deficient because it is highly susceptible to uneven wear of the slide surface members. As the guide arrangement does not include levelling devices, some slide surface members will likely wear faster and less evenly than others. As the surface members wear unevenly, the possibility of carriage misalignment increases. Further, the slide surface members do not appear to easily replaceable. The replacement of the slide surface members would therefore apparently include significant manhours.

Therefore, it would be desirable to have a guide system for a reciprocating grate system that would be able to resist the temperatures conditions found in the grating area. Further, it would be desirable to have a guide system for a reciprocating grate system which eliminates the need for wheels, axles, bearings, and side plate restraints, and the aforementioned disadvantages associated therewith. In addition, it would be desirable to have a guide system for a reciprocating grate system which can compensate for tolerances and warping in the carriage and in the fixed undergrate structure to assure even wear on the guide units.

SUMMARY OF THE INVENTION

It is an objective of the invention to provide a guide system for a reciprocating grate that is resistant to the physical and temperature conditions found in the environment of the grate.

It is another objective of the present invention to provide a guide system for a reciprocating grate which eliminates the need for wheels, shafts, and bearings.

It is yet another objective of the present invention to provide a guide system for a reciprocating grate which eliminates the necessity for lateral restraints, by providing wear plates which perform the dual functions of permitting longitudinal reciprocatory movement in the direction of fuel flow, and maintaining lateral alignment of the movable carriage and the movable grate block rows.

It is a further objective of the invention to provide a guide system for a reciprocating grate wherein the guide units include wear plates which are angularly displaced from each other to: (i) maintain lateral alignment of the movable carriage and the movable grate block rows, and (ii) provide additional wear surface area to increase the useful life of the wear plates.

It is another objective of the present invention to provide a guide system with wear plates for a reciprocatory grate wherein worn wear plates may be easily replaced.

In accordance with these objectives and others that will become apparent from the description herein, the invention provides a guide system for a reciprocating grate system. The grate system includes a grate surface, alternating rows of stationary and movable grate blocks, a movable carriage, a fixed undergrate structure, and a driving force device. The movable rows of grate blocks attached to the movable carriage, and the stationary rows of grate blocks attached to the fixed undergrate structure. The driving force device is structurally coupled to the fixed undergrate structure and to the movable carriage for imparting reciprocatory movement to the movable rows of grate blocks. The grate system supports and pushes fuel along the grate surface for combustion, and the guide system guides the movable carriage and the movable grate block rows with respect to the fixed undergrate structure and the stationary grate block rows during the reciprocatory movement. The guide system includes a front guide unit and a rear guide unit longitudinally spaced from the front guide unit. The guide units guide the movable carriage and the movable rows of grate blocks with respect to the fixed undergrate structure and the stationary rows of grate blocks during a reciprocating stroke cycle of the driving force device. Each guide unit includes a fixed guide member and a movable guide member. The fixed guide member is attached to the fixed undergrate structure and has an upper non-linear contour with at least one upper wear surface. Each movable guide member is attached to the movable carriage and has a lower non-linear contour with at least one lower wear surface. The lower non-linear contour is generally complementary shaped to the upper non-linear contour. When the movable carriage is in an installed position, the upper wear surface and the lower wear surface are in slidable contact with each other.

The invention also provides a guide system for a reciprocating grate system. The grate system includes a grate surface, alternating rows of stationary and movable grate blocks, a movable carriage, a fixed undergrate structure, and a driving force device. The movable rows of grate blocks attached to the movable carriage, and the stationary rows of grate blocks attached to the fixed undergrate structure. The driving force device is structurally coupled to the fixed undergrate structure and to the movable carriage for imparting reciprocatory movement to the movable rows of grate blocks. The grate system supports and pushes fuel along the grate surface for combustion, and the guide system guides the movable carriage and the movable grate block rows with respect to the fixed undergrate structure and the stationary grate block rows during the reciprocatory movement. The guide system includes a front guide unit and a rear guide unit longitudinally spaced from the front guide unit. The guide units guide the movable carriage and the movable rows of grate blocks with respect to the fixed undergrate structure and the stationary rows of grate blocks during a reciprocating stroke cycle of the driving force device. Each guide unit includes a fixed guide member and a movable guide member. The fixed guide member is attached to the fixed undergrate structure and has an upper contour with at least one upper wear surface. Each movable guide member is attached to the movable carriage and has a lower contour with at least one lower wear surface. The lower contour is generally complementary shaped to the upper contour. When the movable carriage is in an installed position, the upper wear surface and the lower wear surface are in slidable contact with each other. A levelling device on either the fixed guide member or the movable guide member prevents uneven wear of the wear surfaces during operation.

Other objects of the invention will become apparent from the drawings and detailed description below.

DETAILED DESCRIPTION

Figure 1:
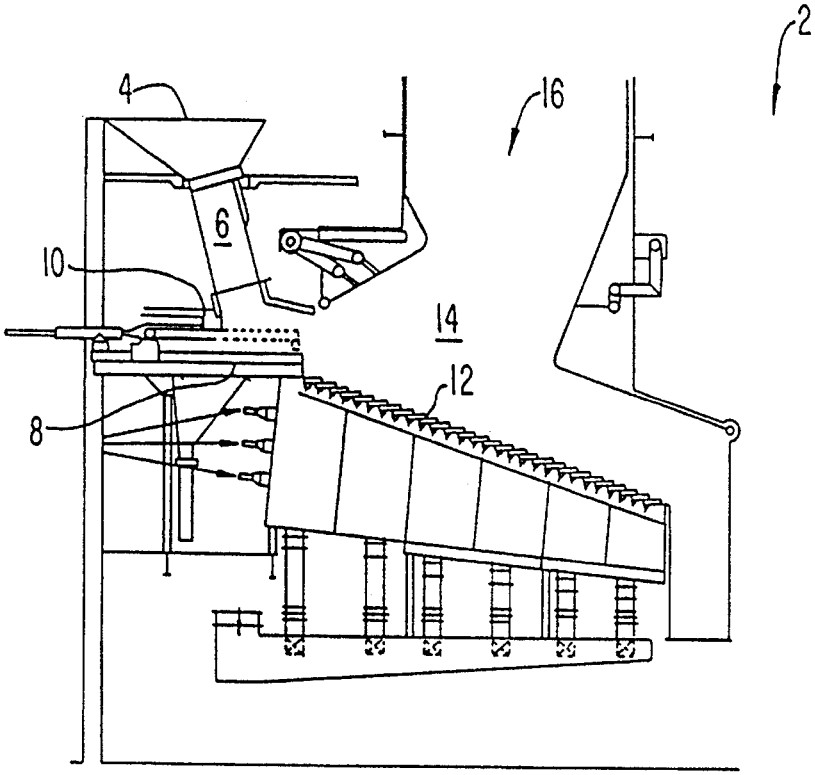
FIG. 1 PRIOR ART
FIG. 1 depicts a vertical cross section of a typical prior art refuse-to-energy plant.
Figure 2:
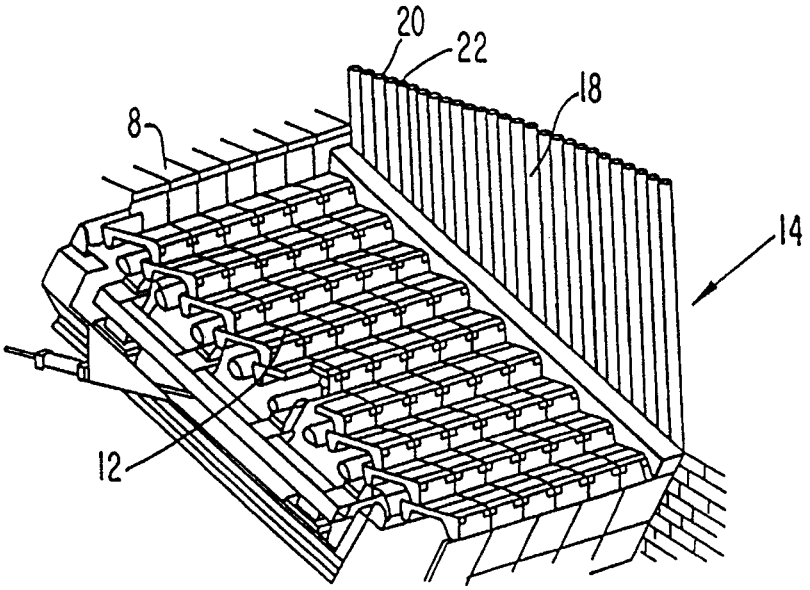
FIG. 2 PRIOR ART
FIG. 2 illustrates a perspective view of the lower portion of the prior art refuse-to-energy plant of FIG. 1.
Figure 3:
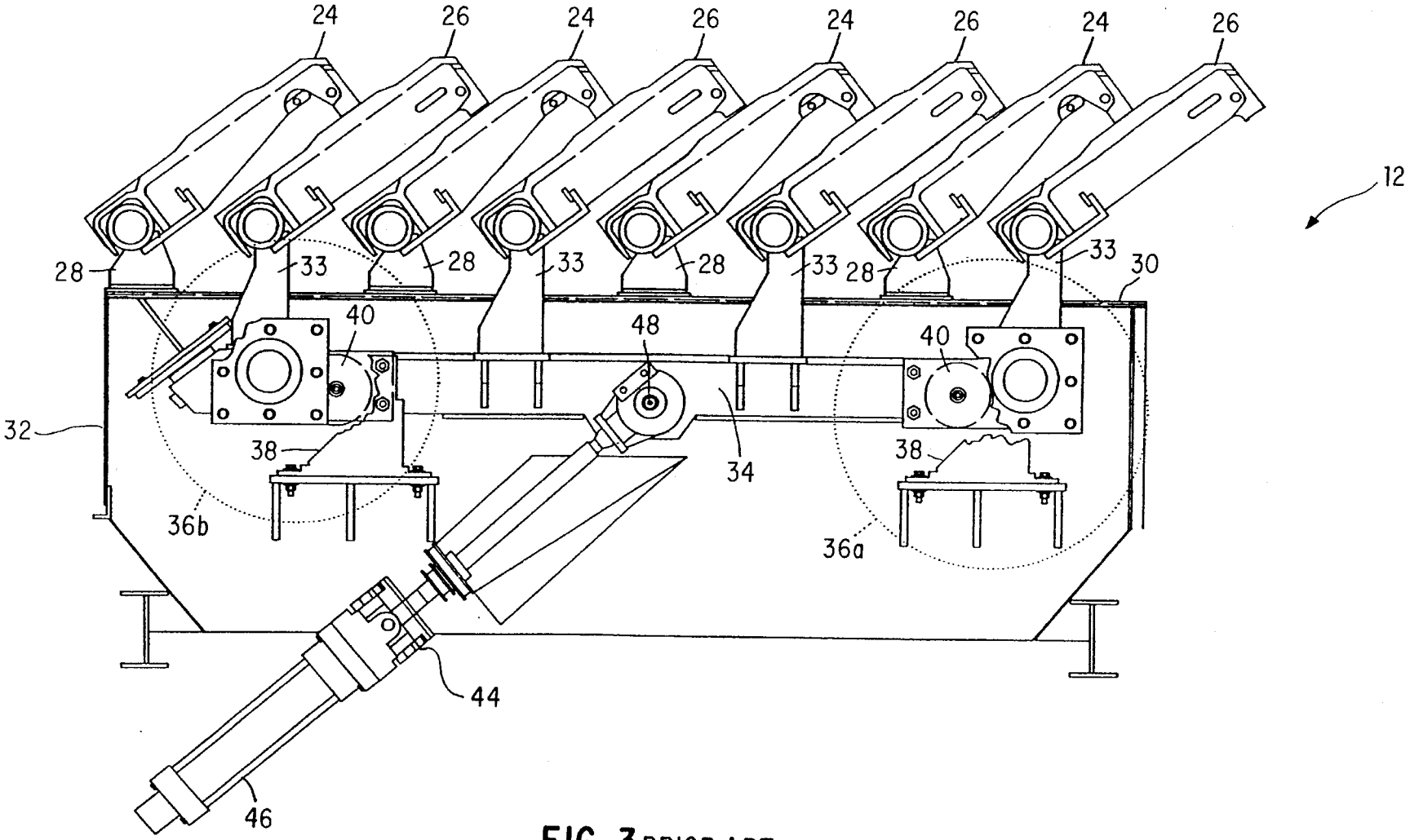
FIG. 3 PRIOR ART
FIG. 3 is an elevational view of the right side of a prior art reciprocating grate system having a guide system with wheels and ramps which some elements shown in cross-section.

A preferred reciprocating grate system for steam generating facilities is best shown in FIGS. 4–10 and is indicated generally by reference numeral 112. As in the prior art grate system 12 of FIG. 3, grate system 112 is a forward moving reciprocating-type with the rows of grate blocks 124 and 126 inclined at an angle, e.g. 18°, from the horizontal. The grate blocks are grouped into rows perpendicular to the direction of refuse flow. The rows of grate blocks consist of alternating rows of stationary grate blocks 124 and reciprocating grate blocks 126. Each row of grate blocks overlaps the row ahead of it to provide the grate system surface.

Stationary grate block rows 124 are attached to supports 128, which are attached to a table 130 forming part of the fixed undergrate structure 132. Movable grate block rows 126 are supported by and are attached, via supports 133, to a common carriage 134, i.e., a movable undergrate structure. Attachment of the blocks 124 and 126 to supports 128 and 133 is made at the back part of the grate blocks which is located below the prior overlapping block. Supports 133 extend through, and travel within, longitudinal slots in table 130 during the reciprocating motion of reciprocating grate blocks 126.

A cylinder actuator 144 is attached at one end 146 to fixed undergrate structure 132 and to carriage 134 at the other end 148. Cylinder actuator 144 provides the necessary force to reciprocate carriage 134 and movable rows of grate blocks 124 at a desired speed. However, numerous other devices could alternatively be used to provide the necessary reciprocating force, including but not limited to, a non-linear motor coupled to a rotation-to-translation device.

Forward and rearward guide units **136*a* and 136*b* are used to guide carriage 134 in its reciprocating movement with respect to fixed undergrate structure 132. In a preferred arrangement, there are two laterally spaced forward guide units 136*a* and two laterally spaced rearward guide units 136*b*. However, more than two guide units 136 could be laterally spaced across grate 112. Each guide unit 136 includes a fixed interfacing slide 150 and a movable interfacing slide 152. Fixed interfacing slide 150 and movable interfacing slide 152 include interfacing complimentary wear surfaces for guiding carriage 134 in its reciprocatory movement in the direction of refuse flow, i.e., longitudinally, and for preventing significant undesirable lateral movement of carriage 134**.

Figure 6:
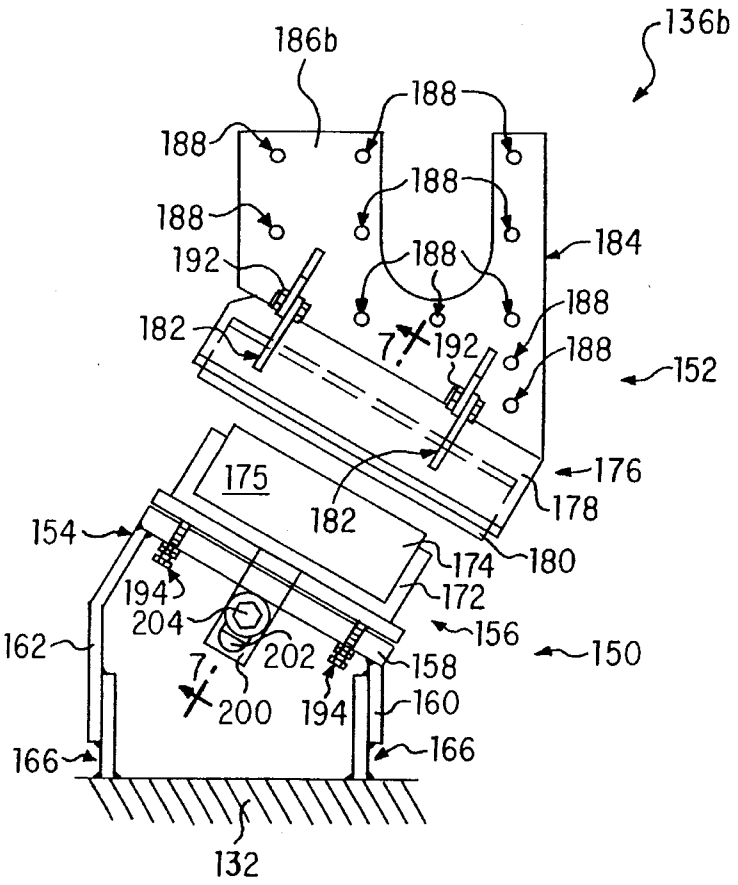
FIG. 6 is a detailed elevational view of the left side of the rear guide unit of the reciprocating grate system of FIG. 4.
Figure 5:
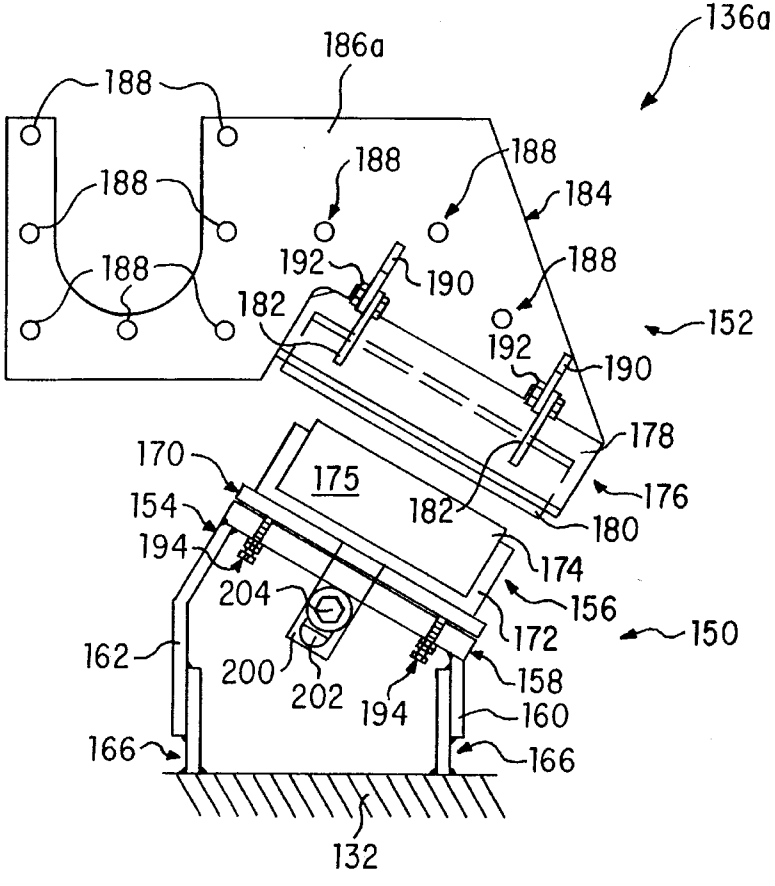
FIG. 5 is a detailed elevational view of the left side of the front guide unit of the reciprocating grate system of FIG. 4.
Figure 8:
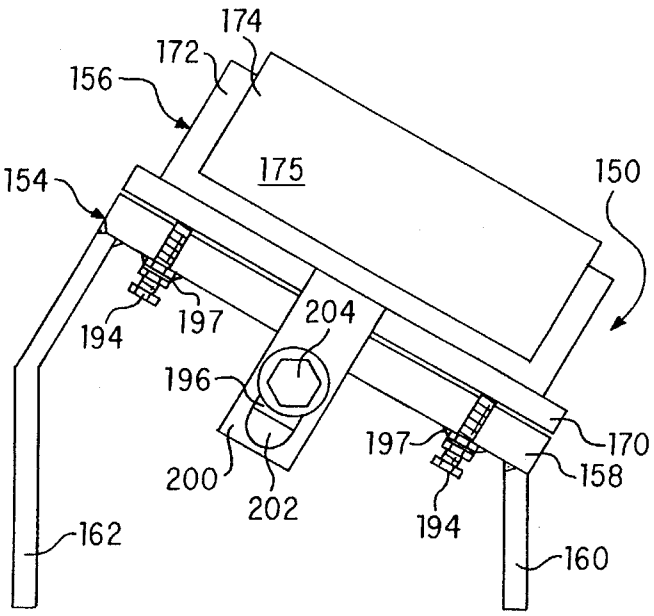
FIG. 8 is a side elevational view of the fixed interfacing slide.

As seen in FIGS. 5–8, fixed interfacing slide 150 includes a mounting base 154 and a slide assembly 156. Mounting base 154 includes a base plate 158 and front and rear legs 160 and 162 extending downward from base plate 158. As illustrated in FIGS. 5 and 6, legs 160 and 162 are fixedly attached at their lower ends, preferably by welding, to wall gussets 166 which are attached to, or are part of, fixed undergrate structure 132.

Figure 10:
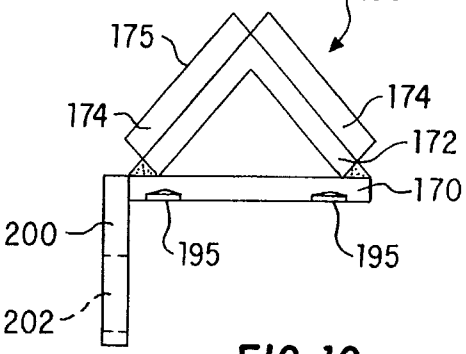
FIG. 10 is a front elevational view of the slide assembly on the fixed interfacing slide.
Figure 9:
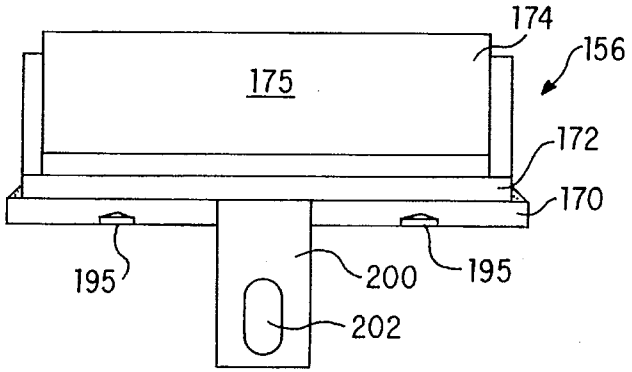
FIG. 9 is a side elevational view of the slide assembly on the fixed interfacing slide.

As illustrated in FIGS. 9 and 10, slide assembly 156 includes a base 170, an inverted V-shaped rail 172 attached at its lower ends to base 170, and wear plates 174 mounted on the upper outwardly facing surfaces on each side of V-shaped rail 172. Wear plates 174 include wear surfaces 175 for contacting, supporting, and guiding wear surfaces which are attached to movable interfacing slide 152.

Figure 7:
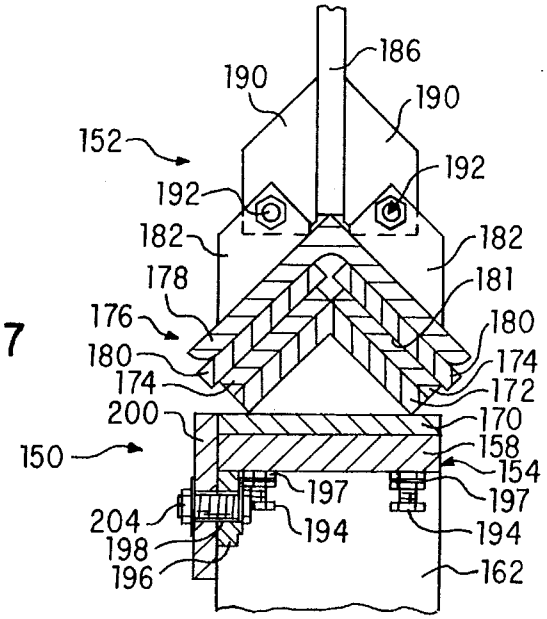
FIG. 7 is cross-sectional view taken through lines 7—7 of FIG. 6 depicting the fixed and movable interfacing slides.

Referring to FIGS. 5–7, movable interfacing slide 152 includes a slide assembly 176 and a carriage mount assembly 184. Slide assembly 176 has an inverted V-shaped rail 178 with wear plates 180 attached, preferably by welding, to both lower inner surfaces of inverted V-shaped rail 178. Each wear plate 180 includes a wear surface 181 which interfaces with a wear surface 175 on a respective wear plate 174 of fixed interfacing slide 150. The upper surfaces of inverted V-shaped rail 178 include gusset plates 182 fixedly attached thereto for interfacing with carriage mount assembly 184.

Carriage mount assembly 184 includes a carriage mounting plate **186*a* or 186*b*, which is of a slightly different design for each front and rear guide unit 136*a* and 136*b*. Front and rear carriage mounting plates 186 include carriage mounting hole 188 therein. The size and shape of plates 186, as well as the size and location of holes 188**, are designed to respectively attach to the front and rear of a specific carriage design, and thus can be shaped and sized differently to interface with other carriage designs.

Gusset plates 190 are fixed to opposing sides of plates 186. Gusset plates 190, as well as gusset plates 182, each include holes therein which are aligned with one another for assembly. Conventional hardware attachment devices 192, e.g., nuts and bolts, are used to removably attach gusset plates 182 and 190 together. During operation, this effectively provides an arrangement whereby: (i) wear surfaces 175 are fixedly attached to fixed undergrate structure 132, (ii) wear surfaces 181 are fixedly coupled to carriage 134, and (iii) wear surfaces 175 and 180 slide against each other during the reciprocatory motion of carriage 134.

As cylinder actuator 144 is reciprocated, wear surfaces 181 on wear plates 180 are vertically supported by and guided by wear surfaces 175 on respective wear plates 174. The wear plates on the inverted V-shaped interfacing contours accomplish at least two important functions. First, the V-shaped configuration eliminates the necessity for lateral side plate restraints because lower wear plates 174 inherently guide carriage 134 by preventing any significant undesirable lateral movement of upper wear plates 180. In addition to eliminating the necessity for lateral side plate restraints, this configuration also likely increases the useful product life of any grate block sidewall seals located between the grate and the furnace side walls, as the reduced lateral movement of the carriage reduces the wear on the grate block sidewall seals.

In a preferred embodiment, wear plates 174 and 180 are preferably made of manganese steel having a Brinell Hardness value between 400–600. However, it is recognized that other hardness values and/or other materials suitably fitted for providing the necessary wear capabilities in the intended temperature environment could be used.

Additionally, the inverted V-shaped interfacing contours provide more surface wear area as compared to a single planar wear plate having the same plan size. The additional wear area is beneficial because it spreads the weight of carriage 134 over a larger area, causing plates 174 and 180 to wear at a slower rate as compared to a single planar wear plate of the same plan size. As plates 174 and 180 wear at a slower rate, the useful life of the wear plates is therefore lengthened.

Figure 4:
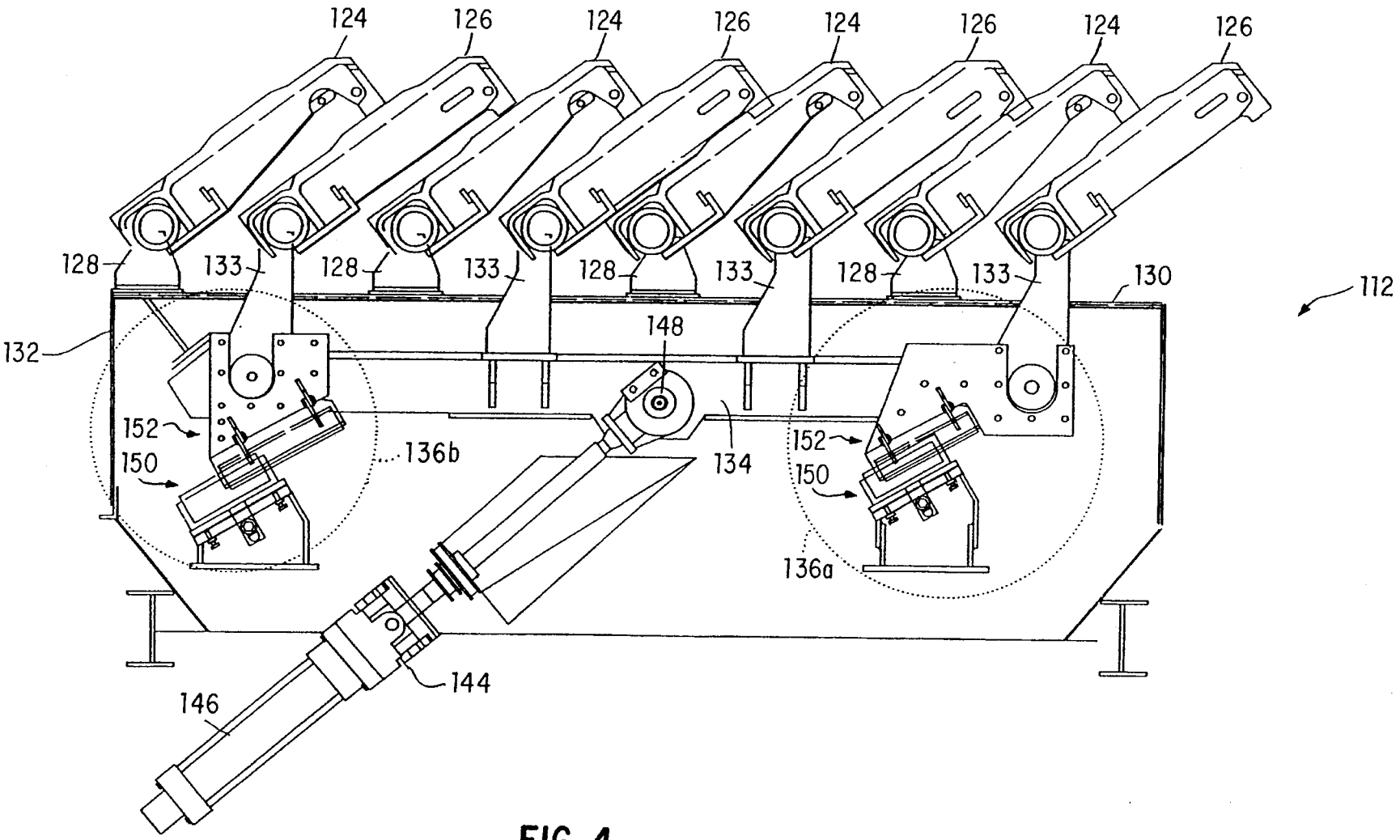
FIG. 4 is an elevational view of the right side of the reciprocating grate system of the present invention which some elements shown in cross-section.

Further, as can be seen in FIGS. 4–6, wear plates 180 and rail 178 on movable interfacing slide 152 are longer than wear plates 174 and rail 172 on fixed interfacing slide 150, in order to cover wear plates 174 and rail 172 during the full range of motion of carriage 134. This prevents trash siftings which may fall through the holes in table 130 from falling on wear plates 174 and affecting the wear on the plates 174 and 180.

Additionally, guide units 136 include a levelling arrangement which facilitates the precise levelling and alignment of the fixed interfacing slides 150 with respect to their respective movable interfacing slides 152, and with respect to all of movable interfacing slides 152. This in turn, minimizes uneven wear on wear plates 174 and 180, and decreases the potential for carriage 134 misalignment. The levelling arrangement compensates for warping and poor tolerances in carriage 134 and fixed undergrate structure 132.

Levelling arrangement includes four levelling bolts 194 in each guide unit 136 which extend upwardly through mounting base plate 158 and support the slide assembly base 170. The location of four levelling bolts 194 are located near the corners of mounting base plate 158 to permit small adjustments within three degrees-of-freedom. Levelling bolts 194 may be attached to base plate 158 via threaded through-holes in base plate 158 or nuts 197 welded to the lower surface of base plate 158. The ends of levelling bolts 194 each extend into, and are attached to, corresponding bores 195 in base 170. Thus, levelling bolts 194 are threadingly attached to base 170 and base plate 158 to precisely position base 170 and to prevent relative movement between base plate 158 and base 170. Further, as all of the guide units 136 include a levelling arrangement, even wear can be obtained on the wear plates of each individual guide unit 136 and on the wear plates of all four guide units 136.

Upon proper levelling of slide assembly 156, base 170 can be welded or otherwise attached to mounting base plate 158 to fixedly couple inverted V-rail 172 and wear plates 174 to mounting base assembly 154. To assure that inverted V-rail 172 and wear plates 174 do not move with respect to mounting base assembly 154 in the event of a weld or an attachment failure, a secondary retaining system is provided.

The secondary retaining system includes a locking bar 196 on mounting base 154 and a locking bar 200 on base 170. One of the locking bars 196 or 200 includes a hole 198 while the other includes a slot 202. In the preferred embodiment locking bar 200 on base 170 includes slot 202. Conventional mechanical connectors 204, e.g., bolt, nut, washers, and spacers, are used to affix locking bar 196 and 200 together. Thus, in the event that the weld between base plate 158 and base 170 fails, the secondary retaining system will prevent base 170 from moving with respect to base plate 158.

In the event that replacement of wear plates 174 and 180 is necessary, guide system 112 facilitates such a replacement. Wear plates 180 on movable interfacing slide 152 can be replaced by simply removing mounting hardware 192, replacing the used slide assembly 176 with a new slide assembly, and reattaching mounting hardware 192. Wear plates 174 on fixed interfacing slide 150 can be replaced by removing mechanical connector 204, cutting the weld between base 170 and base plate 158, and replacing the used slide assembly 156 with a new slide assembly. New slide assembly 156 would then be levelled by levelling bolts 194, and attached to mounting base 154 as previously described herein.

It is to be understood that the disclosed embodiments are merely illustrative of the principles of the present invention which could be implemented by other types of structures which would be readily apparent to those skilled in the art. Accordingly, the scope of the present invention is to be determined in accordance with the appended claims.

What is claimed is:

1. A guide system in a reciprocating grate system, the grate system including a grate surface, alternating rows of stationary and movable grate blocks, a movable carriage, a fixed undergrate structure, and driving force means, the movable rows of grate blocks attached to the movable carriage, the stationary rows of grate blocks attached to the fixed undergrate structure, the driving force means structurally coupled to the fixed undergrate structure and to the movable carriage for imparting reciprocatory movement to the movable rows of grate blocks, the grate system supporting and pushing fuel along the grate surface for combustion, the guide system guiding the movable carriage and the movable grate block rows with respect to the fixed undergrate structure and the stationary grate block rows during the reciprocatory movement, said guide system comprising:

front and rear guide units, said front guide unit longitudinally spaced from said rear guide unit, said guide units guiding said movable carriage and said movable rows of grate blocks with respect to said fixed undergrate structure and said stationary rows of grate blocks during a reciprocating stroke cycle of the driving force means, each guide unit including a fixed guide member and a movable guide member;

each said fixed guide member attached to said fixed undergrate structure and having an upper non-linear contour with at least one upper wear surface, each said movable guide member attached to the movable carriage and having a lower non-linear contour with at least one lower wear surface, said lower non-linear contour being generally complementary shaped to said upper non-linear contour, wherein when said movable carriage is in an installed position said at least one upper wear surface and said at least one lower wear surface are in slidable contact with each other;

said guide units further including levelling means for adjusting the position of one of said upper wear surface and said lower wear surface with respect to the other of said upper wear surface and said lower wear surface to prevent uneven wear of the wear surfaces during operation.

2. The invention of claim 1, wherein said fixed guide member includes a first angular rail having a first apex and two sides extending outwardly and downwardly from the first apex with the ends of the two sides opposite the first apex attached to said fixed undergrate structure, said fixed guide member further having at least two upper wear members with at least one thereof attached to a respective upper surface of each side of the first angular rail, each said upper wear member including an upper wear surface, and said movable guide member includes a second angular rail having a second apex with two sides extending outwardly and downwardly from the second apex, wherein said second angular rail is attached to the movable carriage, said movable guide member further having at least two lower wear members with at least one thereof attached to a respective lower surface of each side of the second angular rail, each said lower wear member including a lower wear surface.

3. The invention of claim 2, wherein said guide system includes two laterally spaced front guide units and two laterally spaced rear guide units, each said fixed guide member attached to a respective mounting base assembly and each said movable guide member attached to the underside of said movable carriage.

4. The invention of claim 3, wherein each said mounting base assembly includes said levelling means.

5. The invention of claim 4, wherein said levelling includes a plurality of levelling bolts which adjusts the position of the first angular rail with respect to the mounting base assembly.

6. The invention of claim 4, wherein each said first angular rail is fixedly coupled to its respective mounting base assembly during operation.

7. The invention of claim 3, wherein each said mounting base assembly and each said fixed guide member includes a locking bar extending therefrom, said locking bar on said fixed guide member removably attached to said locking bar on its respective mounting base assembly.

8. The invention of claim 2, said upper wear members preventing significant lateral movement of said movable carriage.

9. The invention of claim 3, further including a pair of mounting plates each mounted on a respective upper surface of each side of the second angular rail.

10. The invention of claim 2, wherein said at least two upper wear members are welded to the respective upper surface of each side of the first angular rail and said at least two lower wear members are welded to the respective lower surface of each side of the second angular rail.

11. The invention of claim 1, wherein the reciprocating grate system is attached within a refuse-to-energy unit, and the grate system supports and pushes refuse along the grate surface for combustion.

12. A guide system in a reciprocating grate system, the grate system including a grate surface, alternating rows of stationary and movable grate blocks, a movable carriage, a fixed undergrate structure, and a driving force means, the movable grate block rows attached to the movable carriage, the stationary rows of grate blocks attached to the fixed undergrate structure, the driving force means structurally coupled to the fixed undergrate structure and to the movable carriage for imparting reciprocatory movement to the movable rows of grate blocks, the grate system supporting and pushing fuel along the grate surface for combustion, the guide system guiding the movable carriage and the movable grate block rows with respect to the fixed undergrate structure and the stationary grate block rows during the reciprocatory movement, said guide system comprising:

front and rear guide units, said front guide unit longitudinally spaced from said rear guide unit, said guide units guiding said movable carriage and said movable rows of grate blocks with respect to said fixed undergrate structure and said stationary rows of grate blocks during a reciprocating stroke cycle of the driving force means, each guide unit including a fixed guide member and a movable guide member; each said fixed guide member attached to said fixed undergrate structure and having an upper contour with at least one upper wear surface, each said movable guide member attached to the movable carriage and having a lower contour with at least one lower wear surface, said lower contour generally complementary shaped to said upper contour, wherein when said movable carriage is in an installed position said at least one upper wear surface and said at least one lower wear surface are in slidable contact with each other;

said guide units further including levelling devices for adjusting the position of one of said upper wear surface and said lower wear surface with respect to the other of said upper wear surface and said lower wear surface to prevent uneven wear of the wear surfaces during operation.

13. The invention of claim 12, wherein said upper and lower contours are non-linear, said fixed guide member includes a first angular rail having a first apex and two sides extending outwardly and downwardly from the first apex with the ends of the two sides opposite the first apex being attached to said fixed undergrate structure, said fixed guide member further having at least two upper wear members with at least one thereof being attached to the respective upper surface of each side of the first angular rail, each said upper wear member including an upper wear surface, and said movable guide member includes a second angular rail having a second apex with two sides extending outwardly and downwardly from the second apex, wherein said angular slide plate is attached to the movable carriage, said movable guide member further having at least two lower wear members with at least one thereof being attached to the lower surface of each side of the second angular rail, each said lower wear member including a lower wear surface.

14. The invention of claim 12, wherein said fixed guide member includes a mounting base assembly, said levelling means includes a plurality of levelling bolts which adjusts the position of said at least one upper wear surface with respect to the mounting base assembly.

15. The invention of claim 12, said at least one upper wear surface preventing significant lateral movement of said movable carriage.

16. The invention of claim 12, wherein the reciprocating grate system is attached within a refuse-to-energy unit, and the grate system supports and pushes refuse along the grate surface for combustion.

* * * * *